US007504981B2

(12) United States Patent
Hong et al.

(10) Patent No.: US 7,504,981 B2
(45) Date of Patent: Mar. 17, 2009

(54) REMOTE CONTROL DEVICE, IMAGE PROCESSING APPARATUS HAVING THE SAME AND METHOD OF DRIVING THE SAME

(75) Inventors: Joo-sun Hong, Suwon-si (KR); Baik-hee Han, Suwon-si (KR); Yong-soo Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 390 days.

(21) Appl. No.: 11/501,752

(22) Filed: Aug. 10, 2006

(65) Prior Publication Data

US 2007/0085824 A1 Apr. 19, 2007

(30) Foreign Application Priority Data

Oct. 17, 2005 (KR) ..... 10-2005-0097575

(51) Int. Cl.
*G08C 19/12* (2006.01)

(52) U.S. Cl. ..... 341/176; 345/168; 348/734

(58) Field of Classification Search ..... 341/176; 345/156, 169; 348/734
See application file for complete search history.

(56) References Cited

U.S. PATENT DOCUMENTS 6,603,420 B1 8/2003 Lu

FOREIGN PATENT DOCUMENTS

| | | |
|---|---|---|
| JP | 09-046778 | 2/1997 |
| KR | 1997-4799 B1 | 4/1997 |
| KR | 1997-58186 | 7/1997 |
| KR | 166695 B1 | 9/1998 |
| KR | 206787 B1 | 4/1999 |
| KR | 100206787 | 4/1999 |

*Primary Examiner*—Timothy Edwards, Jr.
(74) *Attorney, Agent, or Firm*—Roylance, Abrams, Berdo & Goodman, LLP

(57) ABSTRACT

A remote control device that can increase the convenience of a user, a display processing apparatus having the same and a method of driving the same are provided. The remote control device has a moving object and a vibration member generating a vibration. If a vibration is generated as the moving object moves, the remote control generates a signal in response to a moving path of the moving object. The remote control provides the generated signal to an electric device so as to remotely control the electric device. Accordingly, a user can operate the remote control only by moving the remote control so that the user's convenience is increased.

18 Claims, 10 Drawing Sheets

REMOTE CONTROL DEVICE, IMAGE PROCESSING APPARATUS HAVING THE SAME AND METHOD OF DRIVING THE SAME

CROSS-REFERENCE TO RELATED APPLICATIONS

This application claims the benefit under 35 U.S.C. §119 (a) of Korean Patent Application No. 2005-97575 filed on Oct. 17, 2005, in the Korean Intellectual Property Office, the entire disclosure of which is hereby incorporated by reference.

BACKGROUND OF THE INVENTION

1. Field of the Invention

The present invention relates to a remote control device, an image processing apparatus having the same and a method of driving the same. More particularly, the present invention relates to a remote control device that increases the convenience of a user, an image processing apparatus having the same and a method of driving the same.

2. Description of the Related Art

Generally, a remote control device remotely controls an external electronic device by using infrared or radio signals. For example, a television is powered on and off, changes channels and adjusts the volume of audio output according to input signals received from a remote control.

A typical remote control device has keys with certain key values. If a user selects a key, the remote control outputs a signal corresponding to a value of the selected key. In other words, the remote control outputs certain signals according to the key operated by a user. Since each key has a different key value, the remote control device can output various signal corresponding to the key values. Accordingly, a user must visually check the indicia or value displayed on each key before pressing the key. However, it is difficult for a user to visually check the key value if the remote control is being used in a dark place. In such a case, it is hard to accurately use the remote control, and the convenience of using the remote control decreases.

Accordingly, there is a need for an improved remote control device, a system having the same and a method of driving the same.

SUMMARY OF THE INVENTION

Exemplary embodiments of the present invention address at least the above problem and/or disadvantages and provide at least the advantages described below. Therefore, an exemplary object of the present invention is to provide a remote control that can increase the convenience of a user.

Another exemplary object of the present invention is to provide a method for driving the remote control.

Yet another exemplary object of the present invention is to provide a display processing apparatus having the remote control.

Yet another exemplary object of the present invention is to provide a method for driving the display processing apparatus.

According to an exemplary aspect of the present invention, a remote control device includes a chamber, a moving object, a sensor part and a signal generation part.

The exemplary chamber provides a certain space. The exemplary moving object is provided in the chamber to move in an inclining direction of the chamber and has a substantially spherical shape. The exemplary sensor part senses a vibration generated as the moving object moves and outputs a sensor signal according to a moving path of the moving object. The signal generation part outputs a signal according to a value corresponding to the sensor signal.

The exemplary remote control device may further include a vibration member provided in the chamber to generate the vibration by a force against the moving object.

The exemplary remote control device may further include a guide member provided in the chamber to guide the moving object.

The exemplary moving object is positioned in a space defined by the guide member and the vibration member, and the guide member is distanced from the vibration member by a certain interval so that the moving object and the vibration member are closely contacted with each other.

The exemplary sensor part is connected with the vibration member, and the sensor signal is generated in response to the vibration.

An exemplary remote control may have a plurality of the vibration members, and the plurality of vibration members may be distanced from one another by an interval.

The sensor part outputs different sensor signals according to a position of the vibration member generating the vibration.

The plurality of vibration members may include a first vibration member, a second vibration member facing the first vibration member with the guide member disposed between the first vibration member and the second vibration member, a third vibration member provided adjacent to the first and the second vibration members, and a fourth vibration member facing the third vibration member with the guide member disposed between the third vibration member and the fourth vibration member.

An exemplary remote control device may further include a data storage part storing key values set according to the position of the vibration member which generates the vibration and a time for which the vibration is continued.

An exemplary remote control device may further include a plurality of input buttons with different key values, wherein the signal generation part outputs a signal in response to the key value of a selected input button.

According to an exemplary aspect of the present invention, an image processing apparatus includes an image process assembly and a remote control device.

The exemplary image process assembly has an image process part, an image display part and a control part. The image process part decodes an image signal to output the image signal. The image display part receives the image signal from the image process part to display an image. The control part receives an input signal from an outside to output a control signal controlling the image process part. The remote control device has a chamber providing a certain space, a moving object provided in the chamber to move in an inclining direction of the chamber, a sensor part sensing a vibration generated as the moving object moves to output a sensor signal according to a moving path of the moving object, and a signal generation part receiving the sensor signal from the sensor part and outputting a signal according to a key value corresponding to the sensor signal to provide the input signal to the image process assembly.

According to an exemplary aspect of the present invention, a method of driving a remote control device includes outputting a sensor signal according to a moving path of a moving object if a vibration is generated as the moving object moves, generating a key value in response to the sensor signal, and outputting a signal in response to the key value.

The step of outputting the sensor signal includes converting an input mode of the remote control into a vibration mode, and outputting the sensor signal in response to a vibration if the vibration is generated as the moving object moves.

The key value in response to the sensor signal is set according to a position in which the vibration is generated and a time period for which the vibration is continued.

If the vibration is generated by a force between the moving object and at least one vibration members disposed on the moving path of the moving object, a sensor signal corresponding to the vibration is output.

According to an exemplary aspect of the present invention, a method of driving an image processing apparatus includes displaying an image in response to an image signal, outputting a sensor signal according to a moving path of a moving object, converting the sensor signal into a corresponding key value, outputting a signal in response to the key value, and executing an operation in response to the signal to display a result of the executed operation.

The step of displaying the result of the executed operation in response to the signal includes changing the channel if the signal is a channel conversion request, adjusting a volume in response to the signal if the signal is a volume adjustment request, and changing a position of a cursor on a present displayed menu screen to a position in response to the signal if the signal is a cursor conversion request.

If the remote control device, the image processing apparatus having the same, and a method of driving the same according to exemplary embodiments of the present invention are applied, the remote control outputs the signal according to the moving path of the moving object to control the electric devices. Accordingly, a user can operate the remote control without a visual check of the key values of the remote control. Therefore, the convenience of use increases.

BRIEF DESCRIPTION OF THE DRAWINGS

The above aspects and features of the present invention will be more apparent by describing certain exemplary embodiments of the present invention with reference to the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness FIG. 1 is a plan view of a remote control according to an exemplary embodiment of the present invention.

Figure 1:
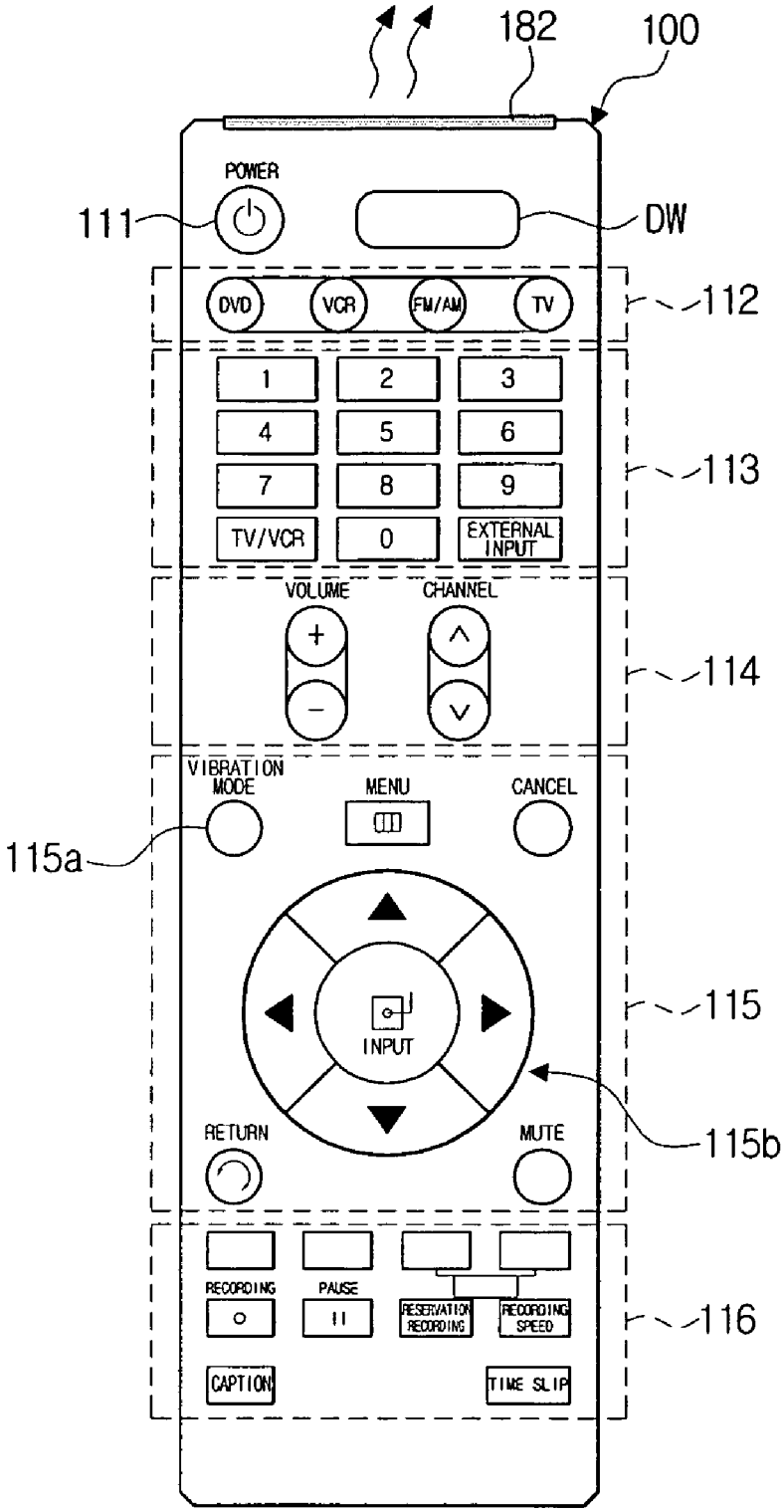
FIG. 1 is a plan view of a remote control according to an exemplary embodiment of the present invention.

Referring to FIG. 1, a remote control 100 according to an exemplary embodiment of the present invention comprises a plurality of keys with certain key values.

The plurality of keys comprise a power key 111 for turning on and off power, device selection keys 112, number keys 113, up and down keys 114, menu related keys 115 and reproduction related keys 116.

The power key 111 powers on and off electric devices that are being controlled by the remote control 100. The device selection keys 112 select electric devices to be controlled by the remote control 100 from among a television, a video cassette recorder (VCR) player, a digital video disk (DVD) player and the like. The up and down keys 114 include an up and down key for adjusting the volume of a television and an up and down key for changing the channel of the television. The menu related keys 115 display at least one menu on the television, change the position of a cursor on the menu and select certain menus.

The menu related keys 115 comprise a vibration mode key 115*a* for changing the input mode of the remote control 100 and direction keys 115*b* for changing the position of cursor to up, down, left and right.

In an exemplary embodiment, the vibration mode key 115*a* changes the present input mode of the remote control 100. The input mode of the remote control 100 may include a general mode for outputting a signal in response to a selected key and a vibration mode for outputting a signal in response to a vibration.

Under the general mode, a signal is output in response to a selected key. If the general mode is set to be the input mode, the remote control 100 generates a signal in response to the key selected by a user among the plurality of keys and outputs the generated signal. Under the vibration mode, a signal is output in response to a vibration generated in the remote control 100. If the vibration mode is set to be the input mode, the remote control 100 generates a signal in response to the vibration generated in the remote control 100 and outputs the generated signal. The vibration mode of the remote control 100 will be explained hereinafter with reference to FIG. 2.

As the vibration mode key 115*a* is selected, the remote control 100 converts, if the present input mode is the vibration mode, the input mode from the vibration mode to the general mode, and converts, if the present input mode is the general mode, the input mode from the general mode to the vibration mode.

The reproduction related keys 116 control the functions of reproducing and recording of the VCR and DVD player. For example, the reproduction related keys 116 reproduce and stop a video of VCR and DVD player or record a broadcast program.

The remote control 100 further comprises a display window DW. The display window DW displays an electronic device that is being controlled by the remote control 100 among the electric devices controlled by the remote control 100. For example, if the remote control 100 is now controlling the television, the display window DW displays 'TV'.

The display window DW may also display the present input mode of the remote control 100. For example, if the input mode of the remote control 100 is the vibration mode, the display window DW displays 'vibration mode'.

Figure 2:
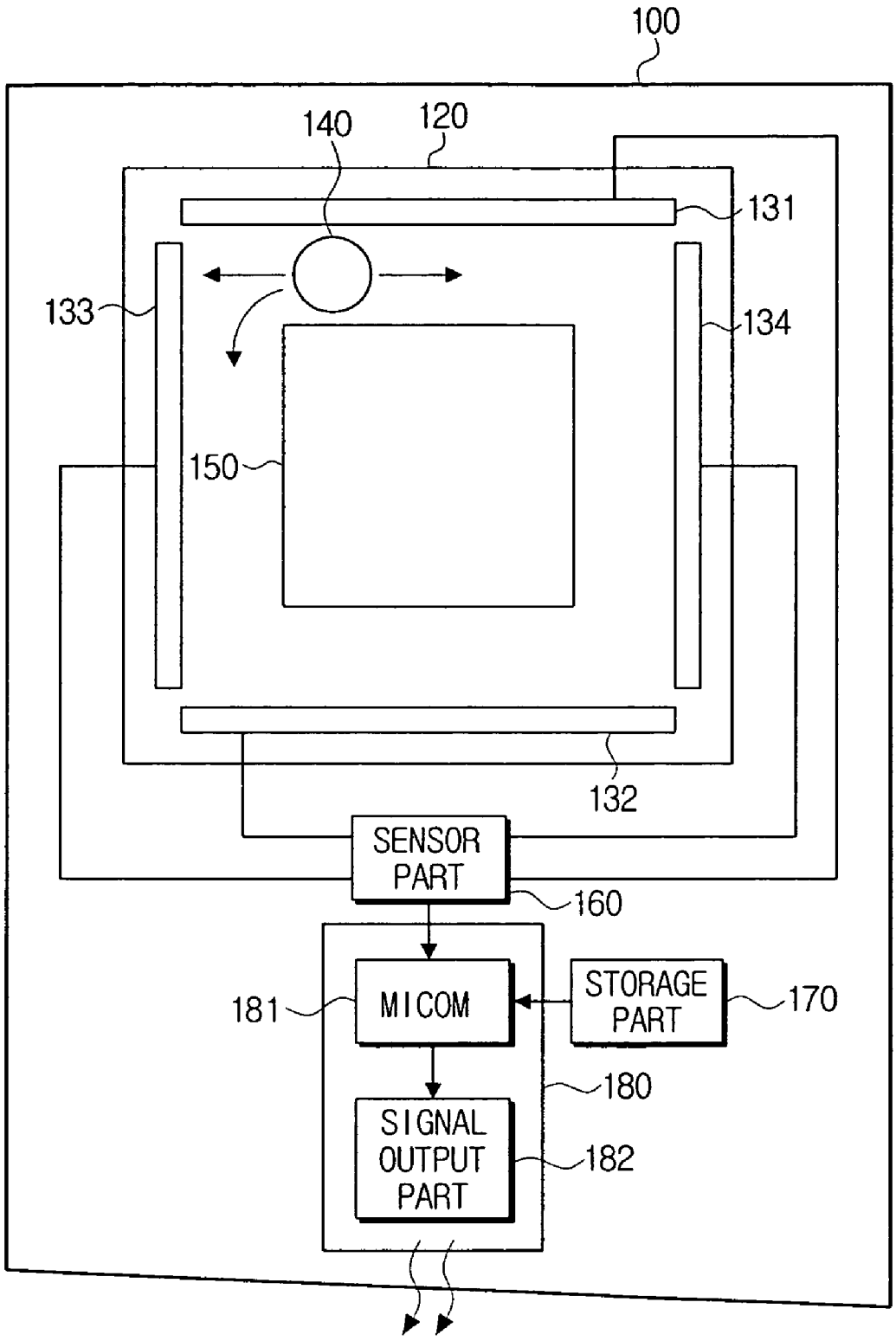
FIG. 2 is a schematic diagram of a configuration of the remote control of FIG. 1.

FIG. 2 is a schematic diagram of configuration of the remote control of FIG. 1.

Referring to FIGS. 1 and 2, the remote control 100 comprises a chamber 120 for providing a certain receiving space, a first through a fourth vibration members 131, 132, 133, 134 provided in the chamber 120, a moving object 140 provided in the chamber 120, a sensor part 160 sensing a vibration, a storage part 170 storing data and a signal generation part 180 outputting a signal.

In an exemplary embodiment, contrary to the plurality of keys of FIG. 1, the members of the remote control 100 shown in FIG. 2 may be provided within the remote control 100 so as not to be exposed to the outside.

In detail, the chamber 120 provides a space for receiving the first through the fourth vibration members 131, 132, 133, 134 and the moving object 140. The chamber 120 provides a space in which the moving object 140 can move.

The first through the fourth vibration members 131, 132, 133, 134 are provided in the chamber 120 and generate vibration by a force against the moving object 140. In an exemplary embodiment of the present embodiment, the remote control 100 has four vibration members; however, the number of the vibration members may be increased or reduced according to the size or use of the remote control 100.

The first through the fourth vibration members may have a plate shape and a rod shape. The first through the fourth vibration members 131, 132, 133, 134 are disposed in edge areas of the chamber 120 and distanced from one another by an interval. In an exemplary embodiment, the first through the fourth vibration members 131, 132, 133, 134 are distanced from inner walls of the chamber 120 so that much vibration can be generated when a force occurs against the moving object 140.

The first vibration member 131 is disposed to face the second vibration member 132, and the first and the second vibration members 131, 132 are disposed adjacent to the third and the fourth vibration members 133, 134, respectively. The third vibration member 133 is disposed to face the fourth vibration member 134.

In the present exemplary embodiment, the moving object 140 is positioned in a space defined by the first through the fourth vibration members 131, 132, 133, 134. The moving object 140 is positioned inside of the first through the fourth vibration members 131, 132, 133, 134 and moved along the inner walls of the first through the fourth vibration members 131, 132, 133, 134. However, the moving object 140 may be positioned in a space defined by the first through the fourth vibration members 131, 132, 133, 134 and the inner walls of the chamber 120. In such a case, the moving object 140 is positioned at the outside of the first through the fourth vibration members 131, 132, 133, 134 and moved along outer walls of the first through the fourth vibration members 131, 132, 133, 134.

If the remote control 100 is inclined in a certain direction by a user, the moving object 140 is moved in the inclining direction of the remote control 100. In other words, if the remote control 100 is inclined to the left or the right, the moving object 140 contacts the first vibration member 131 or the second vibration member 132 so that a vibration is generated at the first or the second vibration member 131, 132. Additionally, if the remote control 100 is upwardly or downwardly inclined, the moving object 140 contacts the third or the fourth vibration member 133, 134 so that a vibration is generated at the third or the fourth vibration member 133, 134.

In the present exemplary embodiment, the moving object 140 has a substantially spherical shape so as to minimize a friction resistance and to easily move. However, this should not be considered as limiting. The moving object 140 may be configured as various types of polygons which can be rotated according to the inclined directions.

The remote control 100 may further comprise a guide member 150 for guiding the moving object 140. The guide member 150 is distanced from the first through the fourth vibration members 131, 132, 133, 134 by intervals. The first through the fourth vibration members 131, 132, 133, 134 surround the guide member 150, and the moving object 140 is moved in a space defined by the first through the fourth vibration members 131, 132, 133, 134 and the guide member 150.

In other words, the guide member 150 is disposed in a central portion of the chamber 120 and guides the moving object 140 to be moved along the inner walls of the first through the fourth vibration members 131, 132, 133, 134. Accordingly, the guide member 150 prevents the moving object 140 from traversing the central portion of the chamber 120, for example, diagonally across the chamber 120.

In the present exemplary embodiment, the moving object 140 is positioned inside of the first through the fourth vibration members 131, 132, 133, 134; however, the moving object 140 may be positioned at the outside of the first through the fourth vibration members 131, 132, 133, 134. If the moving object 140 is positioned at the outside of the first through the fourth vibration members 131, 132, 133, 134, the first through the fourth vibration members 131, 132, 133, 134 can also operate as the guide member 150.

The guide member 150 keeps appropriate distances from the first through the fourth vibration members 131, 132, 133, 134 so that a sufficient space, in which the moving object 140 can be moved, can be obtained and the force against the first through the fourth vibration members 131, 132, 133, 134 can be maximized when the moving object 140 is moved.

The sensor part 160 is connected to the first through the fourth vibration members 131, 132, 133, 134 so as to receive vibrations from the first through the fourth vibration members 131, 132, 133, 134. The sensor part 160 outputs sensor signals in response to the received vibration. At this time, the sensor part 160 outputs various sensor signals according to the vibration members 131, 132, 133, 134 generating vibrations.

In an exemplary embodiment, the sensor signals comprise a first through a fourth sensor signals. If the vibration is received from the first vibration member 131, the sensor part 160 outputs the first sensor signal and if the vibration is received from the second vibration member 132, the sensor part 160 outputs the second sensor signal. If the vibration is received from the third vibration member 133, the sensor part 160 outputs the third sensor signal, and if the vibration is received from the fourth vibration member 134, the sensor part 160 outputs the fourth sensor signal.

The sensor part 160 can receive vibrations from two or more vibration members. If a vibration is received from two or more vibration members, the sensor part 160 selects the vibration member which generates more vibrations in a time period and outputs the sensor signal corresponding to the vibration member. Here, the time period may be set in view of the time required for the moving object 140 to move along one of the vibration members 131, 132, 133, 134. The time period may be set not to exceed the time required for the moving object 140 to move along one of the vibration members 131, 132, 133, 134.

In other words, if moved by operation of a user, the moving object 140 contacts at least one vibration member. If the moving object 140 contacts two or more vibration members, the sensor part 160 outputs the sensor signal corresponding to the vibration member receiving more vibration.

For example, if the moving object 140 is sequentially moved along the inner walls of the first and the second vibration members 131, 132, the vibration is firstly generated at the first vibration member 131. If the moving object 140 is moved via the first vibration member 131 to the second vibration member 132, vibration is generated at the second vibration member 132. Generally, although the two objects causing vibrations are separated, the vibration is left for a certain time.

In other words, if the moving object 140 contacts the second vibration member 132 as separated from the first vibration member 131, the first vibration member 131 still weakly generates a vibration for a certain time. Therefore, the sensor part 160 simultaneously receives the vibrations from the second vibration member 132 and from the first vibration member 131. The sensor part 160 calculates the number of vibrations during a time period received from the first and the second vibration members 131, 132, respectively. Since the number of vibrations during a time period received from the second vibration member 132 is more than that from the first vibration member 132, the sensor part 160 outputs the second sensor signal.

The storage part 170 stores key values corresponding to the time for which each sensor signal and vibration are continued. Then, the storage part 170 stores each sensor signal corresponding to the key values and the time for which the vibration corresponding to each key value is continued, in other words the time for which the same sensor signals are continued. Here, the sensor signal corresponding to each key value may be one of the first through the fourth sensor signals or combined by two or more sensor signals of the first through the fourth sensor signals.

The signal generation part 180 comprises a micom 181 for receiving the sensor signals from the sensor part 160 and for generating signals and a signal output part 182 outputting the signals. The micom 181 determines the kind of received sensor signal and calculates the time in which the sensor signal is continued in order to generate the signal corresponding to the sensor signal.

In the present exemplary embodiment, the micom 181 extracts the key value corresponding to the sensor signal from the storage part 170. However, the micom 181 may calculate the key value corresponding to the received sensor signal by using an algorithm for calculating the key value according to the sensor signal and the time for which the sensor signal is continued.

If one sensor signal or two or more sensor signals are continuously received during a certain time, the micom 181 extracts the key value corresponding to the sensor signals from the storage part 170. Here, a user should control the moving path of the moving object 140 according to an agreed rule so that the remote control 100 generates the sensor signal corresponding to the certain key value.

If the vibration mode key 115*a* is selected by a user, the micom 181 changes the present input mode of the remote control 100. The micom 181 may generate the signals according to the key value corresponding to the key selected by a user, or according to the key value corresponding to the sensor signal to provide the signals to the signal output part 182.

The signal output part 182 outputs the signal received from the micom 181 to the outside. Here, the signal output part 182 may output the signal in forms of infrared ray, wireless frequency or the like.

As described above, the remote control 100 has the moving object 140 therein so as to generate signals according to the moving path of the moving object 140. Accordingly, a user can operate the remote control 100 by inclining the remote control 100 in a certain direction without requiring a visual check of the keys of the remote control 100. In other words, since it is not necessary for a user to check the key values given on each key of the remote control 100, a user can easily operate the remote control 100 in a dark place. Therefore, the convenience of use can increase.

In the present exemplary embodiment, the remote control device 100 of FIGS. 1 and 2 controls a display processing apparatus such as a television, VCR and DVD players. However, the remote control according to exemplary embodiments of the present invention can be applied to control various electric devices such as audio or car navigation system besides the display processing apparatus.

Figure 3:
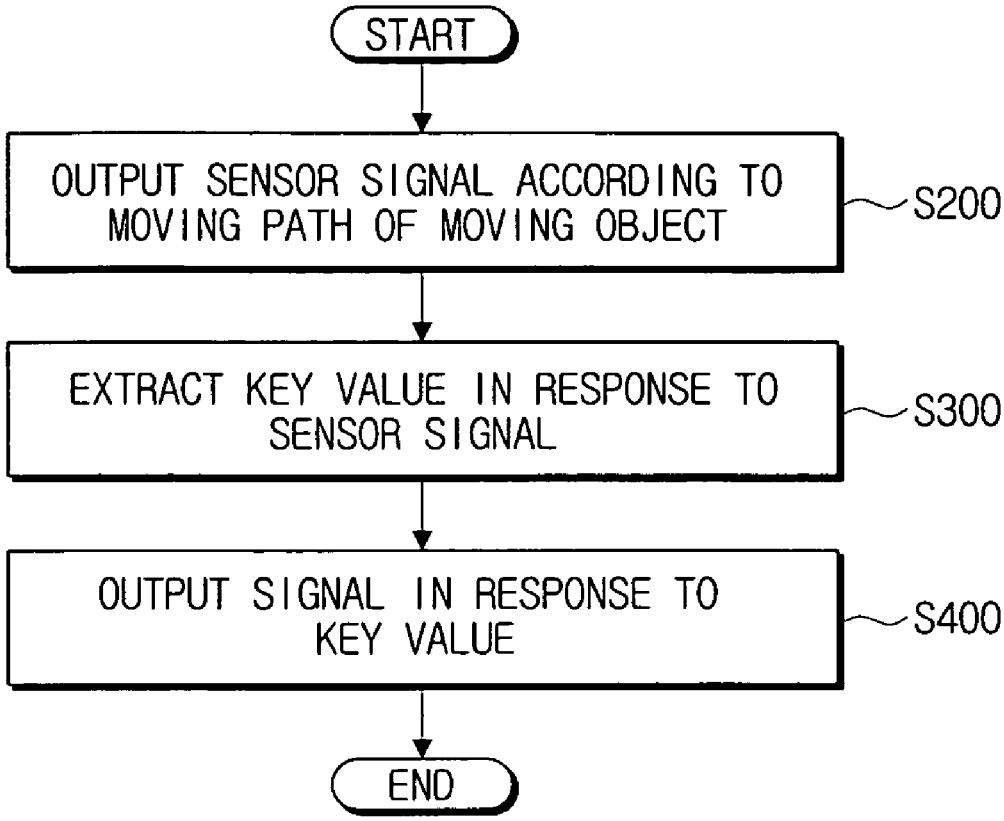
FIG. 3 is a flowchart of driving process of a remote control according to an exemplary embodiment of the present invention.

FIG. 3 is a flowchart of a process of driving a remote control according to an exemplary embodiment of the present invention.

Referring to FIGS. 2 and 3, if the moving object 140 is moved by a user, the sensor part 160 outputs the sensor signal corresponding to the moving path of the moving object 140 to provide the signal to the micom 181 (S200). The process of outputting the sensor signal will be explained later with reference to FIG. 4

The micom 181 extracts from the storage part 170 the key value corresponding to the received sensor signal (S300). The process of extracting the key value will be explained later with reference to FIG. 6

The micom 181 generates the signal corresponding to the extracted key value, and the signal output part 182 outputs the generated signal (S400).

Figure 4:
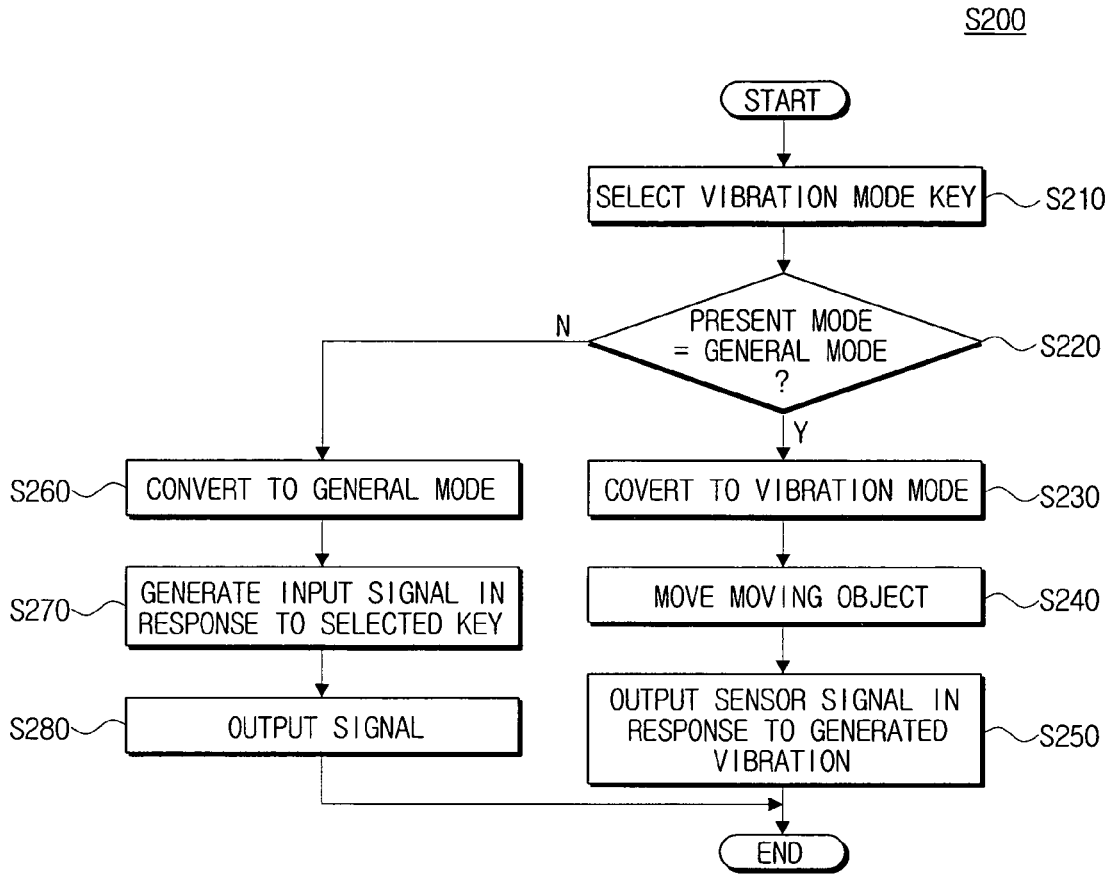
FIG. 4 is a flowchart of a process of outputting sensor signals corresponding to the step of S200 of FIG. 3.

FIG. 4 is a flowchart of the process of extracting the key value of FIG. 3

Referring to FIGS. 2 and 4, the vibration mode key 115*a* (refer to FIG. 1) is selected by a user (S210).

The micom 181 determines if the present input mode is a general mode (S220), and if so, converts the general mode into the vibration mode (S230).

If the moving object 140 is moved in up, down, left or right directions and contacted with a certain vibration member by a user, one of the first through the fourth vibration members 131, 132, 133, 134 that contacts the moving object 140, generates a vibration (S240).

If the vibration is received, the sensor part 160 outputs the sensor signal corresponding to the received vibration among the first through the fourth sensor signals (S250). The process of outputting the sensor signal will be explained later with reference to FIG. 5.

In the step of S220, if the input mode is vibration mode, the micom 181 converts the input mode into the general mode (S260).

If a key is selected among the plurality of keys by a user, the micom 181 generates the signal corresponding to the selected key to provide the signal to the signal output part 182 (S270), and the signal output part 182 outputs the signal (S280).

Figure 5:
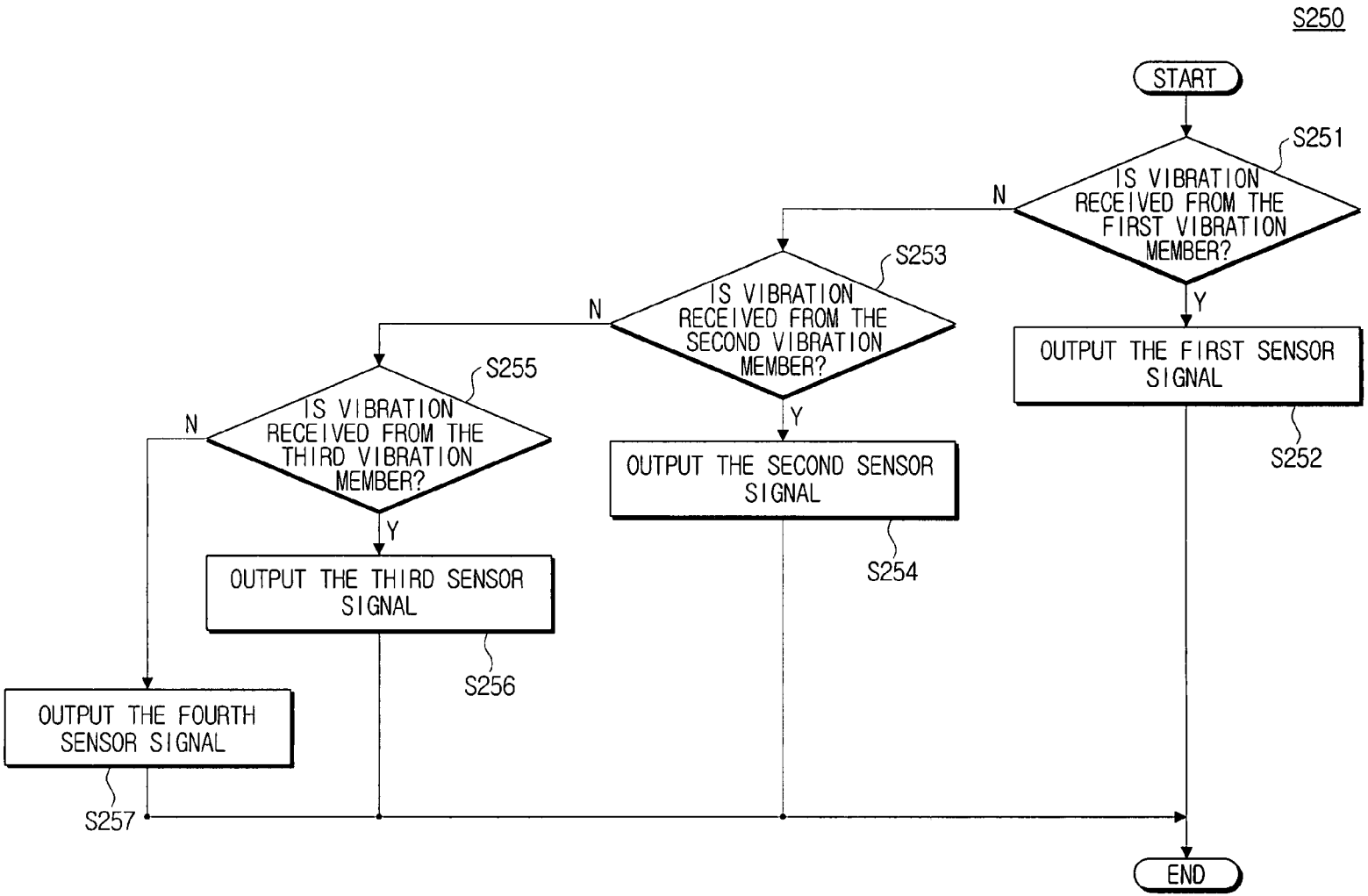
FIG. 5 is a flowchart of a process of outputting different sensor signals depending on positions where vibrations are generated corresponding to the step of S250 of FIG. 4.

FIG. 5 is a flowchart of a process of outputting different sensor signals according to positions where vibrations are generated, of FIG. 4.

Referring to FIGS. 2 and 5, the sensor part 160 determines if the vibration is received from the first vibration member 131 (S251), and if so, outputs the first sensor signal (S252). The sensor part 160 may receive the vibrations generated from the first vibration member 131 together with the vibrations from the other vibration members 132, 133, 134 except for the first vibration member 131. At this time, the sensor part 160 calculates the number of vibrations during a time period for each vibration member, from which the vibrations are received, and if more vibrations are generated from the first vibration member 131, the sensor part 160 outputs the first sensor signal.

If the vibration is not received from the first vibration member 131 in the step of S251, the sensor part 160 determines if the vibration is received from the second vibration member 132 (S253).

If it is determined that the vibration is received from the second vibration member 132 or that the second vibration member 132 generates more vibrations during a time unit in the step of S253, the sensor part 160 generates the second sensor signal (S254).

If the vibration is not received from the second vibration member 132 in the step of S253, the sensor part 160 determines if the vibration is received from the third vibration member 133 (S255).

If it is determined that the vibration is received from the third vibration member 133 or that the third vibration member 133 generates more vibrations during a time unit in the step of S255, the sensor part 160 outputs the third sensor signal (S256).

If it is determined that the vibration is received from the fourth vibration member 134 or that the fourth vibration member 134 generates more vibrations during a time unit in the step of S255, the sensor part 160 outputs the fourth sensor signal (S257).

Figure 6:
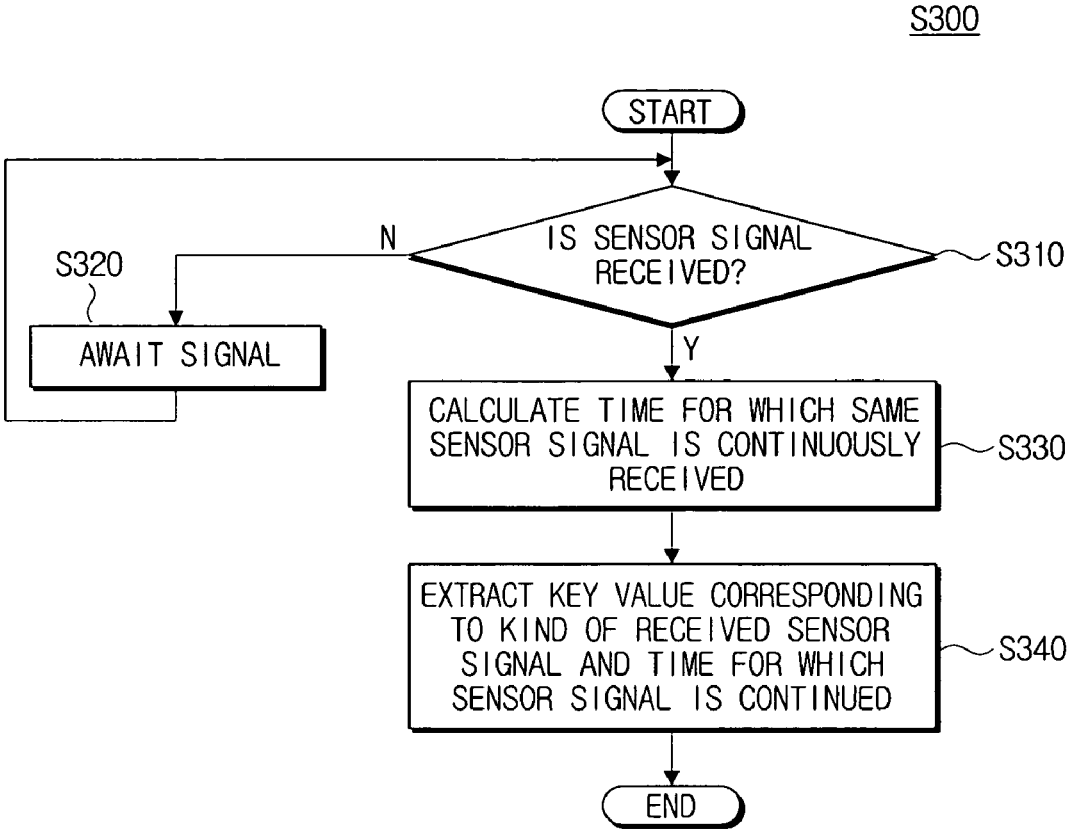
FIG. 6 is a flowchart of a process of outputting key values in response to the sensor signals corresponding to the step of S300 of FIG. 3.

FIG. 6 is a flowchart of outputting key values corresponding to sensor signals of FIG. 3.

Referring to FIGS. 2 and 6, the micom 181 determines if the sensor signal is received from the sensor part 160 (S310).

If it is determined that the sensor signal is not received in the step of S310, the micom 181 awaits till the sensor signal is received or a key is selected by a user (S320).

If it is determined that the sensor signal is received in the step of S320, the micom 181 calculates the time for which the received sensor signals are continued (S330). Here, the micom 181 may receive two or more kinds of sensor signals.

The micom 181 extracts from the storage part the key value corresponding to the kind of received sensor signals and the time for which the sensor signals are continued (S340). Here, the micom 181 extracts the key value corresponding to the sensor signal only if the sensor signal is continuously received longer than a time period.

Figure 7:
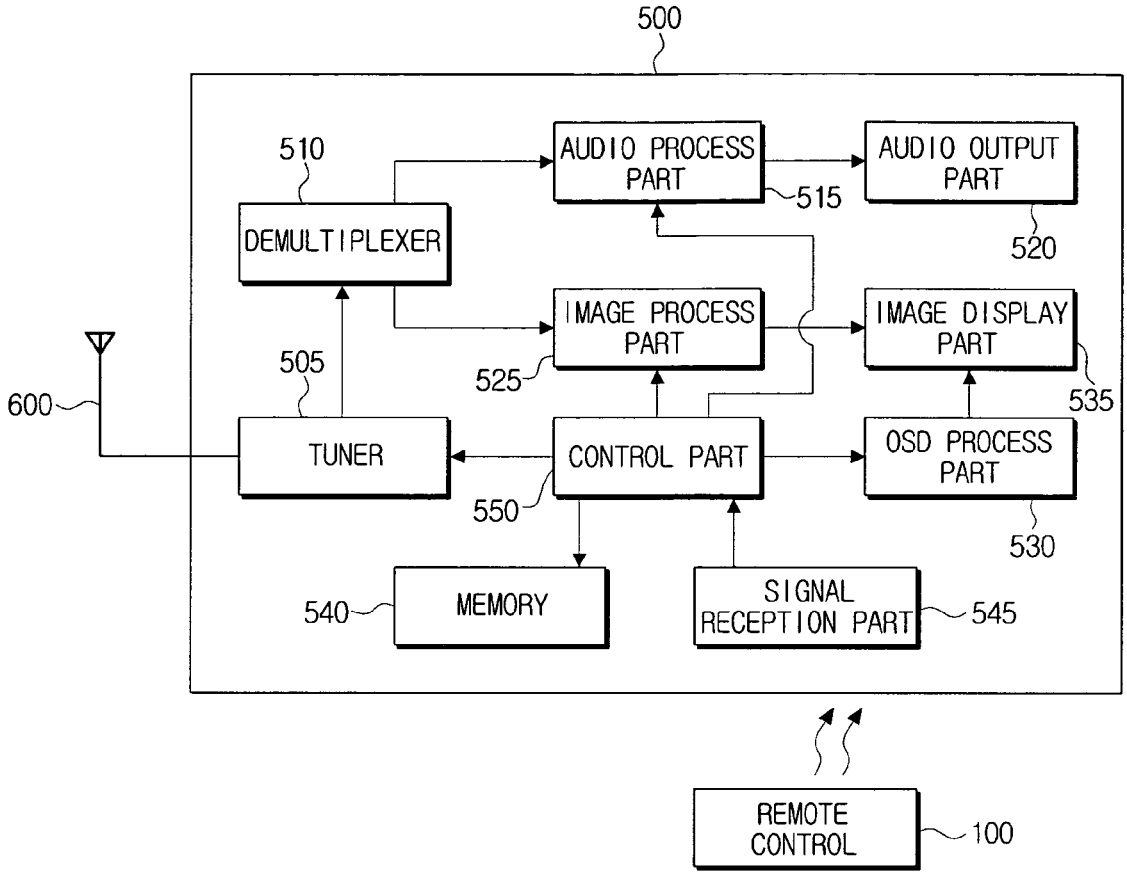
FIG. 7 is a schematic block diagram of a television according to an exemplary embodiment of the present invention.

FIG. 7 is a schematic block diagram of a television according to an exemplary embodiment of the present invention.

Referring to FIG. 7, a television 500 comprises a tuner 505, a demultiplexer 510, an audio process part 515, au audio output part 520, an image process part 525, an on screen display (OSD) control part 530, an image display part 535, a memory 540, a signal reception part 545, and a control part 550.

In detail, the tuner 505 sets an arbitrary channel among a plurality of channels to an input channel and receives a broadcast signal corresponding to the input channel from an antenna 600 of the outside to provide the signal to the demultiplexer 510.

The demultiplexer 510 splits the broadcast signal received from the tuner 505 into an image signal and an audio signal to provide the signal to the audio process part 515 and the image process part 525.

The audio process part 515 decodes the audio signal received from the demultiplexer 510 to provide the signal to the audio output part 520, and the audio output part 520 outputs audio corresponding to the audio signal.

The image process part 525 decodes the image signal received from the demultiplexer 510 to provide the signal to the image display part 535, and the OSD process part 530 generates OSD signals according to the control signal received from the control part 550 to provide the generated OSD signal to the image display part 535.

The image display part 535 receives the image signal from the image process part 525 to display an image and receives the OSD signal from the OSD process part 530 to display OSD letters.

The memory 540 stores necessary data for driving the television 500. For example, the memory 540 stores programs such as games played at the television 500 or data displaying certain menu such as OSD letters.

The signal reception part 545 receives the signals output from the remote control 100 remotely controlling the television 500 to transmit to the control part 550. In the present exemplary embodiment, the remote control 100 has the same configuration as the remote control of FIGS. 1 and 2. Therefore, the repeated description will be omitted for the sake of brevity.

The control part 550 generates control signals controlling the tuner 505, the memory 540, the audio process part 515, the image process part 525, and the OSD process part 530, respectively and provides the generated control signals to each relevant member.

In detail, the control part 550 controls the tuner 505 to set a certain channel to an input channel according to the signal received via the signal reception part 545 from the remote control 100. Additionally, the control part 550 controls the image process part 515 to display a certain menu on the image display part 535 in response to the signal, and controls the image process part 515 to change the image displayed on the image display part 535 according to the signal.

Figure 8:
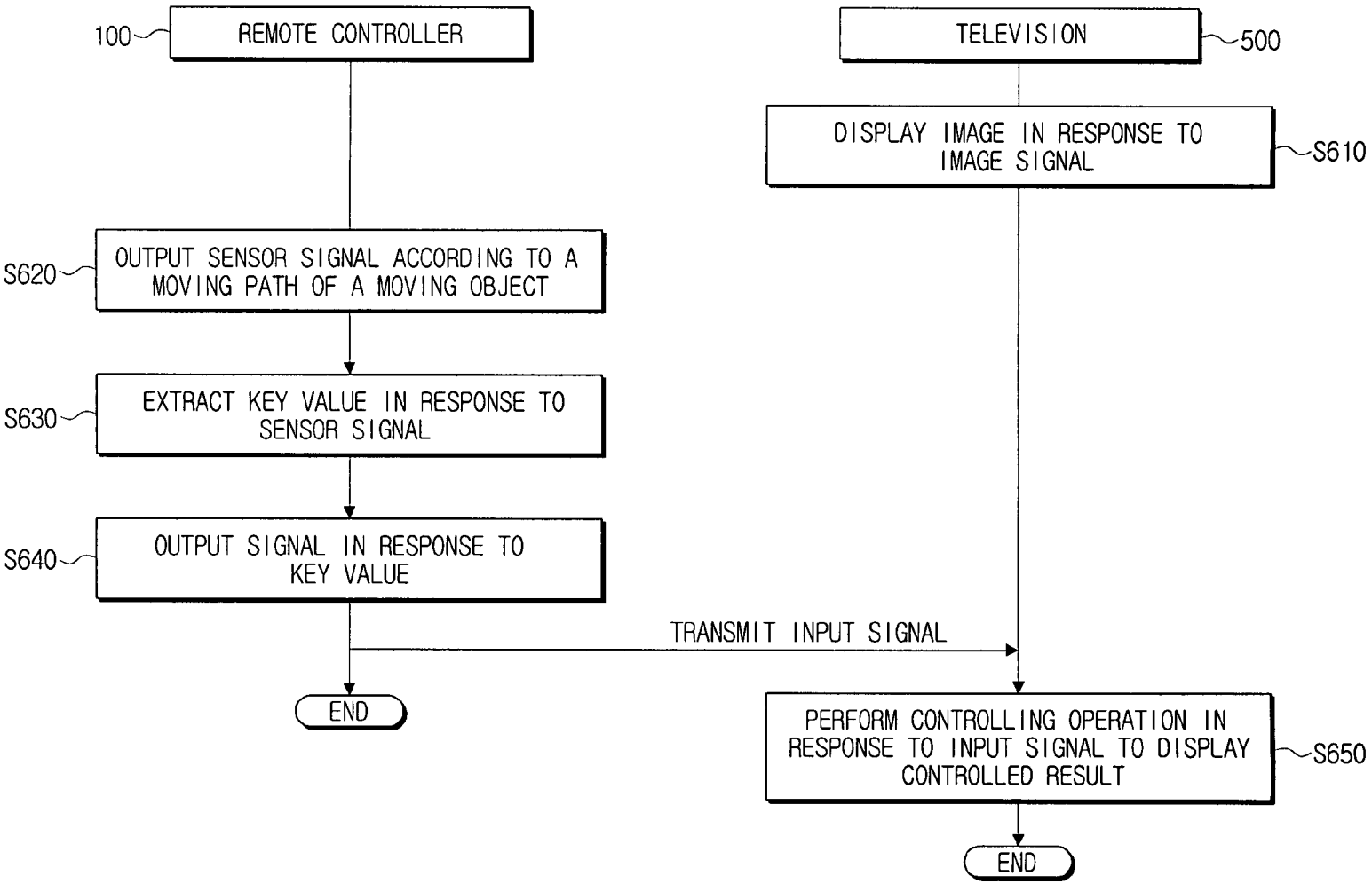
FIG. 8 is a flowchart of a process of operating a television by a remote control according to an exemplary embodiment of the present invention.

FIG. 8 is a flowchart of process of operating a television by using a remote control according to an exemplary embodiment of the present invention.

In the present exemplary embodiment, the process of generating the signal of the remote control 100 (S620, S630, and S640) as shown in FIG. 8 is the same as the process of driving the remote control 100 (S200, S300, and S400) as shown in FIG. 3. Therefore, the repeated description will be omitted for the sake of brevity.

First, the television 500 displays an image corresponding to the image signal (S610). The television 500 may receive an image signal from VCR or DVD player or a broadcast signal to display the image.

The remote control 100 generates a sensor signal according to the moving path of the moving object 140 (refer to FIG. 2) provided in the remote control 100 (S620), and extracts the key value corresponding to the sensor signal (S630). Here, the present input mode of the remote control 100 is a vibration mode, and as a user inclines the remote control 100 in left and right or up and down directions, the moving object 140 is accordingly moved.

The remote control 100 generates the signal corresponding to the key value to transmit to the television 500 (S640).

The television 500 performs a controlling operation to correspond to the signal received from the remote control 100 and displays the operation result (S650). The process, in which the television 500 performs the certain operation by the signal, will be explained with reference to FIG. 9.

As described above, the remote control 100 generates a certain signal as a user moves the remote control 100 in left and right or up and down directions. Accordingly, a user can control the television 500 by only a simple operation that moves the remote control 100 in a direction during a time period without requiring to the user to check the key values of the remote control 100. Therefore, a user can conveniently operate the remote control 100 in a dark place so that the convenience of use increases.

An example and process of controlling the television 500 according to an exemplary remote control of the remote control 100 will be explained with reference to accompanying figures.

Figure 9:
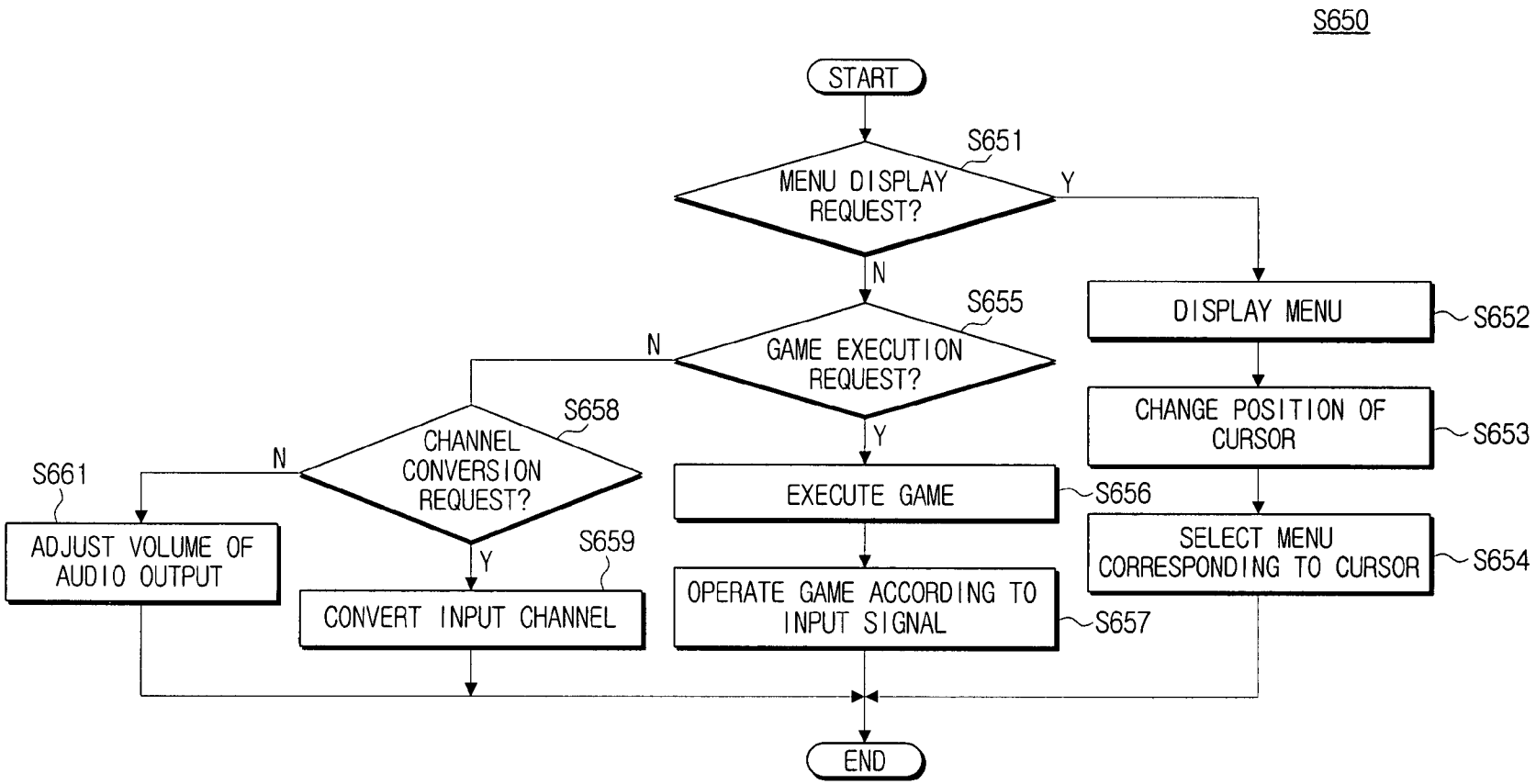
FIG. 9 is a flowchart of a process of outputting a result according to the input signals corresponding to the step of S650 of FIG. 8.
Figure 10:
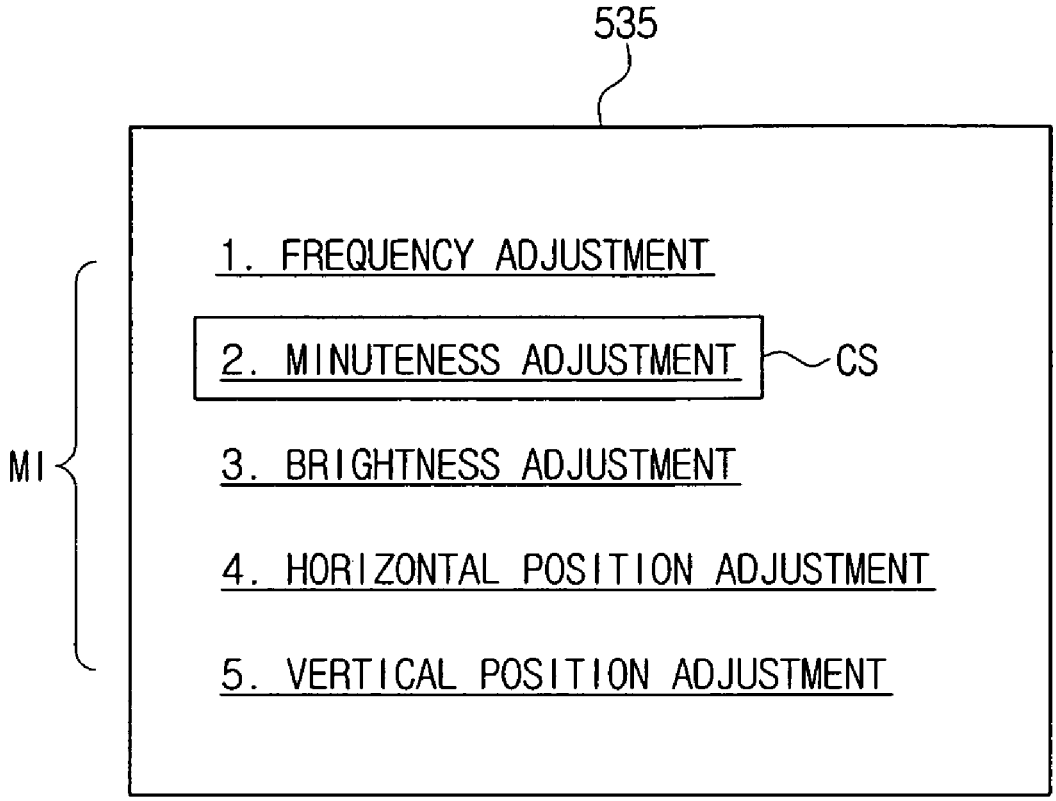
FIG. 10 is a view of an example of a screen for displaying a menu of display part of FIG. 7.

FIG. 9 is a flowchart of an exemplary process of outputting the result according to an input signal of FIG. 8, and FIG. 10 is a view of an example of a screen displaying a menu of a display part of FIG. 7.

Referring to FIGS. 7 and 9, the control part 550 determines if the signal received from the remote control 100 is a menu display request (S651).

If the received signal is the menu display request in the step of S651, the control part 550 extracts an image data corresponding to the menu from the memory 540 to display the menu and provides the data to the image process part 525. The image display part 535 receives the image signal corresponding to the menu from the image process part 525 to display the menu (S652). Here, the image display part 535 may display the menu as the screen of FIG. 10.

Referring to FIG. 10, the image display part 535 displays a plurality of menu items MI for a user to adjust a display setting of the television 500. The menu items MI, for example, may include a frequency adjustment item, a minuteness adjustment item, a brightness adjustment item, a horizontal position adjustment item, a vertical position adjustment item and the like. While the plurality of menu items MI are displayed, a cursor CS is located on an arbitrary item. Here, the location of the cursor CS may be changed according to the signal.

Referring back to FIGS. 7 and 9, if the signal requesting to change the location of the cursor CS is received from the remote control 100 after the step of S652, the control part 550 changes the location of the cursor CS in response to the signal (S653).

Referring to FIGS. 2 and 10, an example of changing the location of the cursor CS will be explained hereinafter. If the input mode of the remote control 100 is a general mode, a user changes the location of the cursor CS by using the direction key 114*b* (refer to FIG. 1) of the remote control 100. However, if the input mode of the remote control 100 is a vibration mode, a user changes the location of the cursor CS by using the moving object 140.

For example, if the cursor CS is now located on the "minuteness adjustment" menu that is the second menu item among the plurality of menu items MI and the moving object 140 is contacted with the first vibration member 131 to generate a vibration at the first vibration member 131, the micom 181 provides a signal to the television 500 requesting to move the cursor CS from the present position to a higher position (refer to FIG. 7). Accordingly, the cursor CS is moved from the second menu item to the first menu item, in other words to the "frequency adjustment" menu.

On the contrary, if the moving object 140 is contacted with the second vibration member 132 to generate a vibration at the second vibration member 132, the cursor CS is moved to the third menu item, in other words to the "brightness adjustment" menu.

For a reference, if a vibration is generated at the third vibration member 133, the cursor CS is moved from the present location to the left, and if a vibration is generated at the fourth vibration member 134, the cursor CS is moved from the present location to the right.

Referring back to FIGS. 7 and 9, if a signal requesting to select a menu via the signal reception part 545 is received from the remote control 100 after the step of S653, the control part 550 selects a menu on which the cursor CS (refer to FIG. 10) is located (S654).

Here, if the input mode of the remote control 100 is a vibration mode and a vibration selecting a certain menu according to a preset rule is generated, the micom 181 (refer to FIG. 3) generates a signal requesting to select a menu to provide the signal to the control part 550 (refer to FIG. 7). The vibration may be generated at all the vibration members 131, 132, 133, 134 (refer to FIG. 3) or at a certain vibration member during a time period. The control part 550 receives the signal requesting to select the menu via the signal reception part 545 and selects the menu indicated by the cursor CS (refer to FIG. 10) according to the received signal.

If the received signal is not the menu display request in the step of S651, the control part 550 determines if the received signal is a game execution request (S655).

If the received signal is the game execution request in the step of S655, the control part 550 executes a game stored in the memory 540 (S656) and operates the game according to the signal (S657). Here, the remote control 100 generates the signal operating the game by using the vibration generated according to the moving path of the moving object 140 (refer to FIG. 2).

If the received signal is not the game execution request in the step of S655, the control part 550 determines if the received signal is a channel conversion request (S658).

If the received signal is the channel conversion request in the step of the S658, the control part 550 changes the present channel in response to the signal (S659). Here, the remote control 100 can generate the signal converting the channel by using the vibration generated according to the moving path of the moving object 140 (refer to FIG. 2).

For example, if a vibration is generated at the first vibration member 131 (refer to FIG. 2), the micom 181 (refer to FIG. 2) generates a signal requesting to convert the input channel into the channel located prior to the present-set input channel. On the contrary, if a vibration is generated at the second vibration member 132 (refer to FIG. 2), the micom 181 (refer to FIG. 2) generates a signal requesting to convert the input channel into the channel located after the present-set input channel.

If the received signal is a volume adjustment request for the audio output part 520 in the step of S658, the control part 550 adjusts the volume of the audio output part 520 in response to the signal (S661). Here, the remote control 100 can generate the signal adjusting the volume by using the vibration generated according to the moving path of the moving object 140 (refer to FIG. 2). The process of generating the signal for adjusting the volume by using the vibration is similar with the aforementioned channel conversion process. Therefore, the detailed description thereof will be omitted for the sake of brevity.

As described above, the remote control according to exemplary embodiments of the present invention has the moving object and generates a signal according to the moving path of the moving object. In other words, if a user moves the remote control in a certain direction, the moving object moves in the same direction. Accordingly, the moving object and the vibration members are contacted with one another to generate vibrations. The remote control generates the signal in response to the vibration and provides the generated signal to an electric device to remotely control the electric device. Therefore, a user can operate the remote control only by simply moving the remote control without requiring a visual check of the key values of the remote control. Accordingly, a user can conveniently operate the remote control in a dark place so that the convenience of use can increase.

While the invention has been shown and described with reference to certain exemplary embodiments thereof, it will be understood by those skilled in the art that various changes in form and details may be made therein without departing from the spirit and scope of the invention as defined by the appended claims and the full scope of equivalents thereof.

What is claimed is:

1. A remote control device comprising:

a chamber;

a moving object provided in the chamber;

a sensor part to sense a vibration generated as the moving object moves and to output a sensor signal according to a path of the moving object; and a signal generation part outputting a signal according to the sensor signal.

2. The remote control device as claimed in claim 1, further comprising at least one vibration member provided in the chamber to generate the vibration.

3. The remote control device as claimed in claim 2, further comprising a guide member provided in the chamber to guide the moving object.

4. The remote control device as claimed in claim 3, wherein the moving object is positioned in a space defined by the guide member and the vibration member, and the guide member is distanced from the vibration member by an interval so that the moving object and the vibration member are closely contacted with each other.

5. The remote control device as claimed in claim 3, wherein the sensor part is connected with the at least one vibration member, and the sensor signal is generated in response to the vibration.

6. The remote control device as claimed in claim 5, wherein the at least one vibration member is provided in a plurality, and the plurality of vibration members are distanced from one another by an interval.

7. The remote control device as claimed in claim 6, wherein the sensor part outputs different sensor signals according to a position of the vibration member generating the vibration.

8. The remote control device as claimed in claim 6, wherein the plurality of vibration members comprises:

a first vibration member;

a second vibration member facing the first vibration member with the guide member disposed between the first vibration member and the second vibration member;

a third vibration member provided adjacent to the first and the second vibration members; and a fourth vibration member facing the third vibration member with the guide member disposed between the third vibration member and the fourth vibration member.

9. The remote control device as claimed in claim 8, further comprising a data storage part storing key values corresponding to the position of the vibration member which generates the vibration and a time for which the vibration is continued.

10. The remote control device as claimed in claim 1, further comprising a plurality of input buttons with different key values, wherein the signal generation part outputs the signal in response to a key value of a selected input button.

11. The remote control device as claimed in claim 1, wherein the moving object comprises a substantially spherical shape.

12. The remote control device as claimed in claim 1, wherein the signal output according to the sensor signal corresponds to a key value.

13. The remote control device as claimed in claim 2, wherein the vibration member provided in the chamber generates the vibration by a friction force against the moving object.

14. An image processing apparatus comprising:

an image process assembly having an image process part decoding an image signal to output the image signal, an image display part receiving the image signal from the image process part to display an image, and a control part receiving a signal from an outside to output a control signal controlling the image process part; and a remote control having a chamber providing a space, a moving object provided in the chamber, a sensor part to sense a vibration generated as the moving object moves and to output a sensor signal according to a moving path of the moving object, and a signal generation part receiving the sensor signal from the sensor part and outputting a signal corresponding to the sensor signal to provide the signal to the image process assembly.

15. A method of driving a remote control device having a moving object, the method comprising:

(a) outputting a sensor signal according to a moving path of a moving object if a vibration is generated as the moving object moves;

(b) generating a key value in response to the sensor signal; and (c) outputting a signal in response to the key value.

16. The method as claimed in claim 15, wherein the step (a) comprises:

(a-1) converting an input mode of the remote control into a vibration mode; and (a-2) outputting the sensor signal in response to the vibration if a vibration is generated as the moving object moves.

17. The method as claimed in claim 16, wherein the key value in response to the sensor signal is set according to a position in which the vibration is generated and a time for which the vibration is continued.

18. The method as claimed in claim 17, wherein if the vibration is generated by a friction force between the moving object and at least one vibration members disposed on the moving path of the moving object, a sensor signal corresponding to the vibration is output.

* * * * *